US010998644B2

(12) United States Patent
Fireaizen

(10) Patent No.: US 10,998,644 B2
(45) Date of Patent: May 4, 2021

(54) ROTATABLE TRANSPONDER SYSTEM

(71) Applicant: ELTA SYSTEMS LTD., Ashdod (IL)

(72) Inventor: Moshe Fireaizen, Halamish (IL)

(73) Assignee: ELTA SYSTEMS LTD., Ashdod (IL)

( * ) Notice: Subject to any disclaimer, the term of this patent is extended or adjusted under 35 U.S.C. 154(b) by 422 days.

(21) Appl. No.: 14/441,787

(22) PCT Filed: Dec. 1, 2013

(86) PCT No.: PCT/IL2013/050985
§ 371 (c)(1),
(2) Date: May 8, 2015

(87) PCT Pub. No.: WO2014/087398
PCT Pub. Date: Jun. 12, 2014

(65) Prior Publication Data

US 2015/0295328 A1 Oct. 15, 2015

(30) Foreign Application Priority Data

Dec. 4, 2012 (IL) ..... 223415

(51) Int. Cl.
*H01Q 21/30* (2006.01)
*H01Q 3/12* (2006.01)
*H01Q 3/26* (2006.01)

(52) U.S. Cl.
CPC ..... *H01Q 21/30* (2013.01); *H01Q 3/12* (2013.01); *H01Q 3/2647* (2013.01)

(58) Field of Classification Search
CPC ..... G01S 13/756; G01S 13/82; G01S 13/767; G01S 3/74; G01S 7/40; G01S 7/021;
(Continued)

(56) References Cited

U.S. PATENT DOCUMENTS 2,908,002 A 10/1959 Van Atta
3,518,672 A * 6/1970 Zimmer ..... G01S 13/82 342/370

(Continued)

OTHER PUBLICATIONS

International Search Report for International Application No. PCT/IL2013/050985, dated Feb. 20, 2014.

*Primary Examiner* — Erin F Heard
*Assistant Examiner* — Helena H Seraydaryan
(74) *Attorney, Agent, or Firm* — Dorsey & Whitney LLP

(57) ABSTRACT

A transponder system is presented, comprising first and second antenna arrays each comprising a plurality of antenna elements arranged in a predetermined geometry. The antenna elements of the first antenna array are respectively interconnected with corresponding antenna elements of the second antenna array by respective connection lines thereby forming plurality of receiving-transmitting pairs of antenna elements. A receiving-transmitting pair is configured to receive an input electro-magnetic signal by one antenna element thereof and transmit a corresponding output signal by the other antenna element, thereby enabling collective collection of a signal waveform and transmission of a corresponding output signal waveform. The first and second antenna arrays are rotatable with respect to one another about at least one predetermined rotation axis, thereby enabling variation of direction of propagation of the output signal waveform with respect to direction of propagation of the collected signal waveform.

23 Claims, 4 Drawing Sheets

(58) Field of Classification Search
CPC .... H01Q 3/2647; H01Q 25/008; H01Q 3/242; H01Q 1/3225; H01Q 21/30; H01Q 3/12; H01Q 9/0414; H01Q 3/46; H04B 7/00
USPC ..... 342/370
See application file for complete search history.

(56) References Cited

U.S. PATENT DOCUMENTS 3,680,137 A * 7/1972 Wright ..... H01Q 3/242 342/368
3,715,749 A * 2/1973 Archer ..... G01S 13/767 342/157
3,731,313 A * 5/1973 Nagai ..... H01Q 3/46 342/370
3,736,592 A 5/1973 Coleman
4,042,926 A * 8/1977 Anderson ..... G01S 13/82 342/173
4,107,609 A * 8/1978 Gruenberg ..... H04B 7/00 342/367
4,121,221 A * 10/1978 Meadows ..... H01Q 25/008 342/370
4,806,938 A * 2/1989 Meadows ..... H04B 7/00 342/370
5,179,386 A * 1/1993 Rudish ..... G01S 7/021 342/371
5,543,807 A * 8/1996 Stangel ..... H01Q 3/242 342/374
5,945,938 A * 8/1999 Chia ..... G01S 13/756 342/175
6,127,981 A * 10/2000 Pritchett ..... H01Q 1/3225 343/711
6,891,509 B2 * 5/2005 Rose ..... H01Q 3/005 343/758
8,446,253 B2 * 5/2013 Ramchandran ..... G01S 3/74 340/572.1
9,232,558 B1 * 1/2016 Tinoco ..... H04B 7/1555
2002/0126062 A1 * 9/2002 Matthews ..... H01Q 3/40 343/795
2009/0305628 A1 * 12/2009 Vavik ..... G01S 13/767 455/14
2011/0001682 A1 * 1/2011 Rao ..... H01Q 9/0414 343/893
2011/0084879 A1 * 4/2011 Brown ..... H01Q 3/2647 342/370
2012/0086602 A1 * 4/2012 Park ..... G01S 3/48 342/372
2012/0182176 A1 * 7/2012 Maunder ..... G01S 7/40 342/147

* cited by examiner

ROTATABLE TRANSPONDER SYSTEM

TECHNOLOGICAL FIELD

The invention relates to transponder/repeater devices configured for receiving and transmitting electro-magnetic signals.

BACKGROUND

Radio frequency transponders are used in a variety of applications. A typical transponder system operates to collect an electromagnetic signal/waveform and transmit a response signal/waveform, being similar to the collected signal or not. Some transponders utilize a plurality of antenna elements in order to enable direction transmission of electromagnetic signals/waveforms resulting from phase variations between signal portions transmitted by different antenna elements.

For example, the known in the art Van-Atta type repeater is disclosed in U.S. Pat. No. 2,908,002. The Van-Atta type repeater is a passive electromagnetic device for receiving an incident electromagnetic wave and transmitting the received wave back in the direction from whence it has been received. The device includes a linear array of no less than four antennas, and means providing electromagnetic paths of equal length between antennas disposed symmetrically with respect to a geometrical center of said linear array.

U.S. Pat. No. 3,736,592 discloses a method and apparatus for obtaining automatic, selective retrodirective beam formation from a circularly symmetric antenna array. This system may be employed in an active or passive manner and accomplishes selective retrodirectivity by manipulation of beam terminals of a multiple beam matrix which in turn controls a multimodal network. The combination of the two matrix networks provides N separate beams from the circular antenna array. Also, by providing gain networks, control of the reradiated beam pattern is possible. This system has the ability to identify the angle of incidence of any particular transmission, and is particularly suited for navigational beacon systems since the reradiated signal can provide bearing information in response to interrogation.

Another example of a radio frequency transponder/repeater is disclosed in U.S. Pat. No. 4,806,938. Here, an array of receiving antenna elements is coupled to an array of transmitting antenna elements to provide a directional antenna system and including additionally an internal radio frequency source which is also coupled to the array of transmitting antenna elements. With such arrangement, an internally generated signal provided by the radio frequency source may be transmitted using the transmitting array of the Van Atta System.

General Description

There is a need in the art for a novel transponder/repeater system capable of repeating a collected signal by transmitting a corresponding signal with a certain adjustable angular shift with respect to direction to origin of the collected signal. There is also a need in the art for a transponder system enabling controllable adjustment of the angular shift between the collected and transmitted signal with respect to one or more axes. Yet there is further a need for a robust transponder system configuration providing reliable operation while being simple to manufacture and operate.

The present invention fulfills the above needs by providing a technique for transponding and/or repeating electromagnetic radiation signals (waveforms) towards a desired direction (i.e. with adjustable angular shift between the received and transmitted signals) while having a relatively simple and robust construction. The technique of the present invention may be used to obviate a need for processing the signals to be received and transmitted, and accordingly it may be implemented utilizing relatively simple and robust analogue circuitry and/or by utilizing a simple digital circuitry.

The transponder of the present invention utilizes two antenna arrays having interconnected antenna elements arranged in a predetermined order, while at least one of the antenna arrays is rotatable with respect to the other to provide a desirably changeable angular shift. It should be noted that the transponder of the present invention is capable of operating as a transponder and/or repeater and for clarity will be referred to herein below as a "transponder". However, the term "transponder" referring to the device should be interpreted as referring to the repeater as well, and also describes retro-repeater and directional repeater systems.

More specifically, the transponder of the present invention comprises a plurality of antenna elements arranged in first and second antenna arrays (e.g. being respectively receiving and transmitting arrays). Each of the antenna elements of the first array is interconnected with an antenna element of the second array, in accordance with the order of said antenna elements in the respective arrays, to form a plurality of receiving-transmitting pairs of antenna elements. The receiving-transmitting pairs are configured such that electromagnetic (EM) signals (electromagnetic radiation) collected by one of the antenna elements of the pair (i.e. receiving element) are routed via a connection line to the second antenna element of the pair (i.e. transmitting element) to be transmitted thereby to form a corresponding electromagnetic signal/radiation. Accordingly, an EM waveform collectively received by the receiving array (e.g. first array), from a certain direction, is reconstructed from the radiation transmitted by the antenna elements of the transmitting array (e.g. second array) to form a waveform of corresponding characteristics propagation in a desired (e.g. controllable) direction.

Typically, the antenna elements of the first and second antenna arrays are paired according to a sequential order of the elements in the arrays, to thereby maintain phase profile (phase variations) of the collected EM signal, associated with the signal's direction of propagation, and reconstruct a corresponding phase profile by the transmitting antenna elements (of the receiving-transmitting pairs) collectively generating a corresponding output (transmitted) signal. More specifically, a wavefront of an electromagnetic signal, propagating from a certain direction, is collected by the plurality of antenna elements of the first array (or the second array) while each antenna element collects the signal with a different phase, or at different times. By providing the connection lines, connecting the antenna elements and forming the receiving-transmitting pairs, with substantially similar electrical properties the signal portions that reach the second antenna element of each pair have similar phase differences between antenna elements and thus form a similar phase profile. The phase profile, generated by signal portions transmitted by antenna elements of the second antenna array, produces a collective wavefront providing a directional output signal which corresponds to the direction of the collected wavefront (signal). It should be noted that the directionality of the collectively transmitted waveform is determined by both the phase relations between the signal portions transmitted by different antenna elements, as well as the geometry and spacing of the antenna elements in the corresponding antenna array.

Unlike various, known in the art transponders (e.g. Van Atta type transponders), the transponder of the present invention is configured such that at least one of the antenna arrays is rotatable about at least one axis with respect to the other antenna array. This enables simple variations of the direction of the collectively transmitted waveform with respect to the collected waveform by varying a relative angle between the orientation of the first and second antenna arrays.

The connection lines, connecting antenna elements of the first and second arrays to form said receiving-transmitting pairs are preferably configured with similar electrical properties, i.e. similar length, electrical impedance (e.g. resistance, inductance and/or capacitance). Additionally, the connection lines may include signal amplifiers configured to operate at a desired frequency range (e.g. radio frequency in the order of 3 GHz and/or X-band of about 10 GHz). In some cases, the transponder system includes an EM isolation system configured to prevent cross-talk between antenna elements of the first and second antenna arrays. Specifically, such an EM isolation system may be employed to reduce cross talk when signal amplifiers are used, and to prevent noise enhancement through resonation "feedback loop".

Thus, according to one broad aspect of the present invention there is provided a transponder system comprising a first and a second antenna array each comprising a plurality of antenna elements arranged in a predetermined geometry. The antenna elements of the first antenna array are respectively interconnected with corresponding antenna elements of the second antenna array by respective connection lines forming a plurality of receiving-transmitting pairs of antenna elements. The receiving-transmitting pairs are configured to receive an input electro-magnetic signal by one antenna element and transmit a corresponding output signal by its corresponding antenna element, thereby enabling collective collection of signal waveform and transmission of a corresponding output signal waveform. At least one of said first and second antenna arrays are rotatable with respect to the other about at least one predetermined rotation axis to thereby enable variation of direction of propagation of the output signal waveform with respect to direction of propagation of the collected signal waveform. The connection lines are preferably of substantially similar length and electrical properties. The first and second antenna arrays may have substantially similar spacing between their antenna elements.

According to some embodiments of the invention each antenna element of the first antenna array is connected to a corresponding antenna element of the second array in accordance with sequential location of the antenna elements within the arrays to form said receiving-transmitting pairs. The first and second antenna arrays may be configured with substantially similar geometries and may have one- or two-dimensional geometries.

According to some embodiments of the present invention, the first and second antenna arrays may be closed loop arrays, being circular or polygonal arrays. The first and second antenna arrays may be concentric with respect to one another. Said at least one rotation axis may comprise an axis intersecting with a plane defined by one or both of the antenna arrays at a center of the closed loop. The antenna arrays may be located in parallel planes. The first and second antenna arrays may intersect with an axis of rotation of said at least one rotatable antenna array.

According to some embodiments, the transponder may comprise an actuation module connected to said at least one rotatable antenna array and configured to enable controllable rotation of said rotatable antenna array about said at least one predetermined rotation axis. Additionally the transponder may comprise a control unit connected to the actuation module and configured for receiving data indicative of a desired angular shift between direction of propagation of the output signal wavefront with respect to direction of propagation of the collected signal waveform, and for operating said actuation module to vary a relative angle between said first and second antenna arrays for providing said angular shift. The control unit may comprise a wireless communication module configured to receive appropriate control signals indicative of said angular shift, said control unit being responsive to said appropriate control signals to operate said actuation module accordingly, to thereby enable remote variation of said relative angle between said first and second antenna arrays.

According to some embodiments the transponder may comprise a plurality of signal amplifiers respectively associated with said connection lines and configured to amplify signals passing between the associated antenna elements of the corresponding receiving-transmitting pair. The plurality of signal amplifiers may be configured to provide substantially similar signal amplification.

According to some embodiments, the plurality of antenna elements may comprise antenna elements configured to receive and transmit electromagnetic radiation with two or more different polarization orientations.

The transponder may comprise an isolation system configured to reduce cross talk between antenna elements of said first and second antenna arrays. The transponder may also comprise a plurality of signal amplifiers respectively associated with the connection lines, wherein the isolation system is configured to suppress said cross talk by a factor greater than signal amplification provided by said signal amplifiers.

The said isolation system may comprise one or more of the following: (a) one or more parasitic antennas; (b) an electromagnetic isolation layer; (c) one or more frequency dividers/multipliers configured to change the frequency of the transmitted signals relative to the frequency of the received signals in accordance with the antenna elements' spacings of said first and second antenna arrays; and (d) one or more filters configured to filter out frequency components associated with the received signals, while transfer frequency components are associated with the transmitted signals in accordance with antenna elements' spacing of said first and second antenna arrays.

According to yet another broad aspect of the present invention there is provided a signal transmission network comprising two or more transponder systems wherein at least one transponder system is configured as described above. The two or more transponders may be arranged at certain locations to enable establishment of signal propagation trajectory along the signal transmission network, such a segment of said signal propagation trajectory being defined between two adjacent transponder systems; wherein a control over the angular shift provided by said at least one transponder system enables establishment of a desired signal propagation trajectory along the network.

According to some embodiments the signal transmission network may comprise a controller connectable to said at least one transponder system and configured and operable to utilize data indicative of a desired trajectory for signal transmission along said signal transmission network, determine at least one corresponding angular shift for said at least one transponder system, and communicate operational instructions indicative of said at least one corresponding angular shift to said at least one transponder system respectively, to thereby establish said desired trajectory through the signal transmission network.

According to yet another broad aspect of the present invention there is provided a transponder comprising a plurality of antenna elements comprising antenna elements associated with first and second antenna arrays having predetermined closed-loop geometry and spacing, each antenna element of the first antenna array being connected to a corresponding antenna element of the second antenna array via a connection line to thereby form a plurality of receiving-transmitting pairs of antenna elements. At least one of said first and second antenna arrays is rotatable about at least one axis to thereby enable variation of a relative angle between said first and second antenna arrays.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
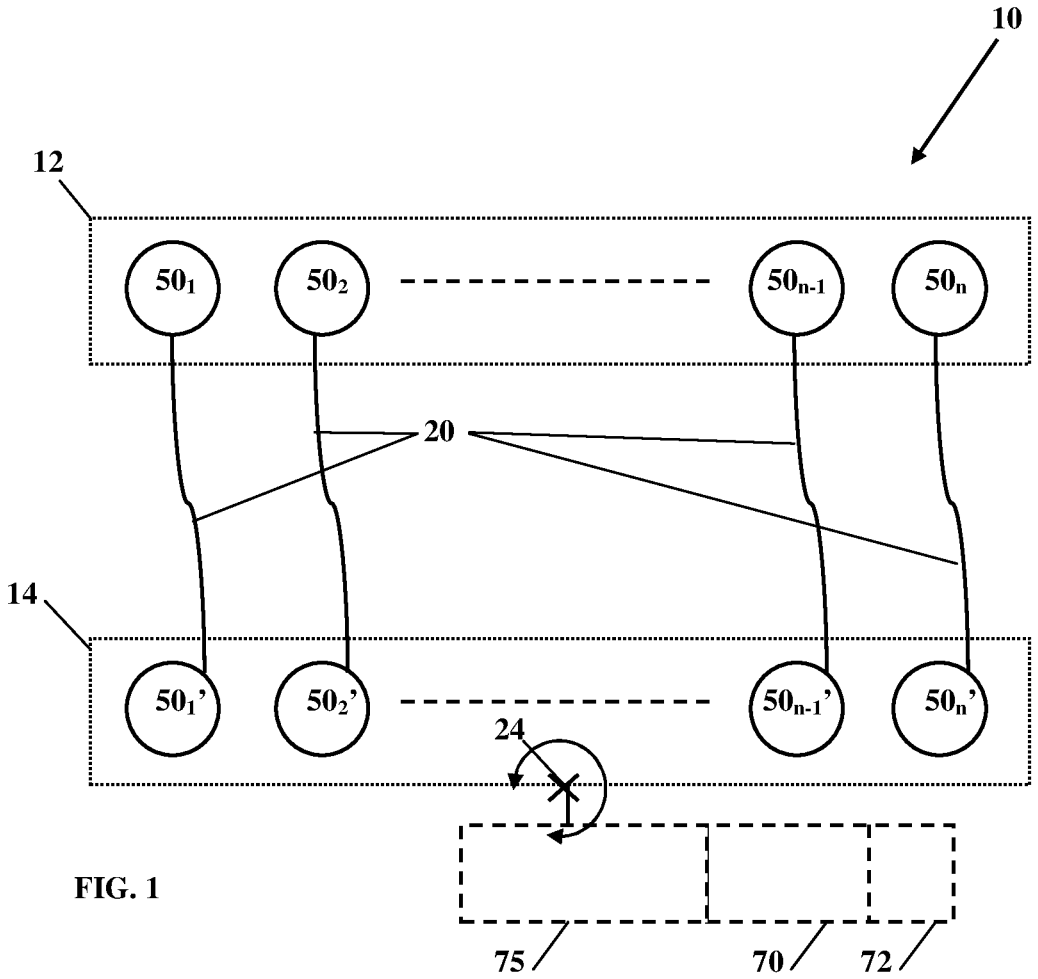
FIG. 1 schematically illustrates a transponder configured according to the present invention.

Reference is made to FIG. 1 schematically illustrating a transponder 10 including first 12 and second 14 antenna arrays, each including a plurality of antenna elements $\mathbf{50}_1$-$\mathbf{50}_n$ and $\mathbf{50}_1'$-$\mathbf{50}_n'$ respectively. The antenna elements $\mathbf{50}_i$ of the first antenna array 12 are interconnected via a plurality of connection lines 20 to antenna elements $\mathbf{50}_i'$ of the second antenna array 14 thereby forming a plurality of receiving-transmitting pairs of antenna elements. At least one of the first 12 and second 14 antenna arrays is rotatable about at least one axis with respect to the other array. In the example illustrated in FIG. 1 the second antenna array 14 is shown as being rotatable about an axis 24 with respect to the first antenna array 12, however it should be noted that the first antenna array 12 may be rotatable, and in some embodiments, both antenna arrays may be rotatable about the parallel or intersecting axes. The receiving-transmitting pairs of antenna elements are configured such that any electromagnetic radiation collected by the receiving antenna element of the pair (e.g. element $\mathbf{50}_i$ of the first antenna array 12) is routed (e.g. electrically conveyed and possibly amplified and/or filtered and/or delayed) via the corresponding connection line 20 and transmitted by the other antenna element of the pair (e.g. element $\mathbf{50}_i'$ of the second antenna array 14). Thus, a waveform collected collectively by the plurality of antenna elements of the first array 12 is conveyed via the connection lines and reconstructed by signal portions transmitted by the antenna elements of the second array 14, and optionally also vice versa. Typically, orientation of the rotatable antenna array (being the first array, the second array or both) is selected to provide a desired angular shift between collected a electromagnetic waveform and a corresponding collectively transmitted electromagnetic waveform as will be described further below with reference to FIG. 2.

It should be noted that according to some embodiments one of the arrays is configured to collect a received waveform while the other array is configured to reconstruct and transmit the collected signals. In such embodiments the connection lines 20 between antenna elements of the first and second antenna arrays may be unidirectional with respect to signal transmission. In some embodiments however both arrays may be configured to receive and transmit EM radiation such that a waveform collected by any one of them is transmitted by the other one. To this end, the connection lines 20 between antenna elements of the first and second antenna arrays may be bidirectional lines. Therefore the receiving antenna elements may be associated with either the first or second antenna array, or all antenna elements may receive and transmit in accordance with the EM radiation present in their vicinity. In some embodiments, as will be described further below with reference to FIG. 3, the connection lines may include signal amplifiers configured to amplify electric signals and to provide amplified repeating/transponding of collected signals.

The transponder 10 may also include an actuation module 75 configured to controllably rotate the rotatable antenna array (second antenna array 14 in the present example) to select a desired angular shift between the collected waveform and the collectively transmitted waveform. The actuation module 75 may be a motor, a piezo-electric actuation module, a manual rotation module or any other type of controllable actuation module configured to controllably rotate the corresponding antenna array. Typically, the actuation module is configured to keep the rotatable antenna arrays in a fixed angular orientation for most of its operation time and rotate the antenna array when a different angular shift between collected and transmitted signals is desired (e.g. by an operator). In this configuration, only when the angular shift is to be changed, the actuation module operates to rotate the corresponding antenna array to a different angular orientation.

Additionally, the transponder 10 may include a control unit 70 connected to the actuation module 75. The control unit 70 is configured to receive data indicative of a desired angular shift between the collected waveform and the collectively transmitted waveform and to controllably operate the actuation module 75 to rotate the appropriate antenna array accordingly. Such data indicative of the desired angular shift may be received through a communication module 72 associated with the control unit 70. The communication module 72 may be a wired or wireless communication module, or it may include an input interface configured to receive manually input data. The control unit 70 may determine an appropriate angular orientation of the rotatable antenna array(s) and operate the actuation module 75 to rotate the antenna array accordingly towards the desired angular shift.

Figure 2:
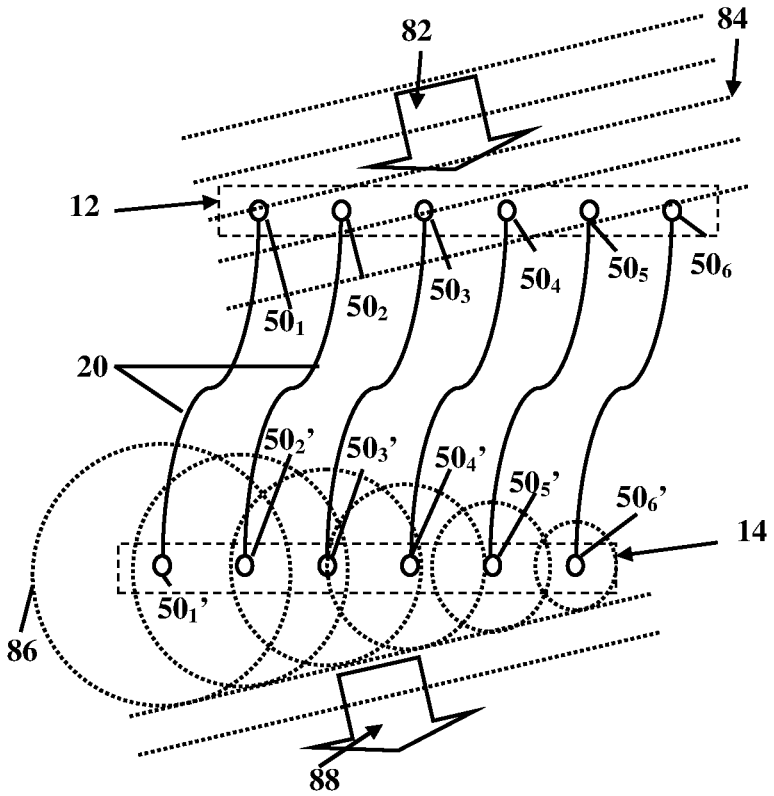
FIG. 2 illustrates some of the main principles describing the operation of the transponder according to the present invention.

FIG. 2 illustrates the main principles of operation of the transponder 10 shown in FIG. 1. In this example, the transponder 10 includes first 12 and second 14 antenna arrays, each including six antenna elements $\mathbf{50}_1$-$\mathbf{50}_6$ and $\mathbf{50}_1'$-$\mathbf{50}_6'$ respectively. The antenna elements $\mathbf{50}_1$-$\mathbf{50}_6$ and $\mathbf{50}_1'$-$\mathbf{50}_6'$ are interconnected between them by connection lines 20 to form receiving transmitting pairs ($\mathbf{50}_1$-$\mathbf{50}_1'$, $\mathbf{50}_2$-$\mathbf{50}_2'$ . . . $\mathbf{50}_6$-$\mathbf{50}_6'$). The antenna elements are sequentially connected/paired in direct or reverse sequential order. When electromagnetic radiation waveform is present near the location of the antenna elements associated with the first antenna array 12, the wavefront 84 of the radiation waveform is received by the antenna elements $\mathbf{50}_1$-$\mathbf{50}_6$ and thereby electric signals are generated by those elements in accordance with their location (e.g. the phase, time delay and amplitude of the signals may vary between the antenna elements). The electric signals received by antenna elements $\mathbf{50}_1$-$\mathbf{50}_6$ are routed, via the respective connection lines 20, to the corresponding antenna elements $\mathbf{50}_1'$-$\mathbf{50}_6'$ and the other end of the receiving-transmitting pairs thereby generating electromagnetic radiation which substantially reproduces the collected waveform (e.g. due to the sequential order of the pairing of the antenna elements of the arrays and similar geometry of the arrays). For example, as shown in the figure, an electromagnetic waveform/signal 82 propagates along a certain direction of propagation and is collected by the first antenna array 12 of the transponder. The repeating wavefronts 84 of the signal 82 are collected by different antenna elements with time delay which corresponds to the distance between the antenna elements and the relative angle between the antenna array 12 and the incoming signal 82. The phase difference between signal portions 86 transmitted by the different antenna elements $\mathbf{50}_1'$-$\mathbf{50}_6'$ of the array, together with sequential pairing of the antenna elements of the arrays, create a collective waveform 88 propagating with an angle from the corresponding antenna array and being similar to the angle between direction of the collected waveform 82 and the corresponding collecting antenna array. Thus, variation of the relative angular orientation of at least one of the first 12 and second 14 antenna arrays generate a corresponding angular shift between the collected 82 and collectively transmitted 86 electromagnetic signals. It should be noted that the first and second antenna arrays preferably have a substantially similar geometry; however the antenna elements of the arrays may form a linear geometry, closed loop geometry, or be arranged in any one- or two-dimensional array. It should also be noted that a substantially similar geometry of the first and second antenna arrays actually means that relative locations of corresponding antenna elements and ratios between distances from one antenna element to another are similar up to an unavoidable manufacturing error. However, in some array geometries, e.g. closed loop array, the sizes of the first and second antenna arrays may be different while maintaining geometrical similarity between the arrays.

According to some embodiments of the present invention the spacing between the antenna elements of the receiving array may be different from the spacing between the antenna elements of the transmitting array. However, since the phase delay $\Delta\varphi$ between adjacent antenna elements depends on the spacing d between the elements, a difference in the elements' spacing, between the spacing $d_r$ in the receiving antenna array and the spacing $d_t$ in the transmitting array, may be compensated by transmitting the signals at different frequency $f_t$ than the frequency of the received signals $f_r$ such that the relation $f_r d_r = f_t d_t$ is preserved in order to maintain coherency over for signals received/transmitted in various angles $\theta$ and avoiding grating lobes.

In some embodiments of the invention in which the elements' spacing is different in the receiving and transmitting antenna arrays ($d_r \neq d_t$), appropriate frequency dividers/multipliers are used for adjusting the frequency of the transmitted signals in accordance with that of the received signals. It is noted that the different frequencies employed for receiving and transmission may contribute to isolation between the arrays.

For example, the connection lines 20 may include or be associated with frequency dividers/multipliers which are appropriately configured to maintain coherency of the signals received/transmitted by each of the antenna elements of each of the first and second arrays to enable the coherent reconstruction of a signal which is received by one of the arrays, by the other array although the elements' spacings are different these arrays. Specifically such frequency dividers/multipliers may be configured such that $$f_t = \frac{d_r}{d_t} f_r.$$

Figure 3:
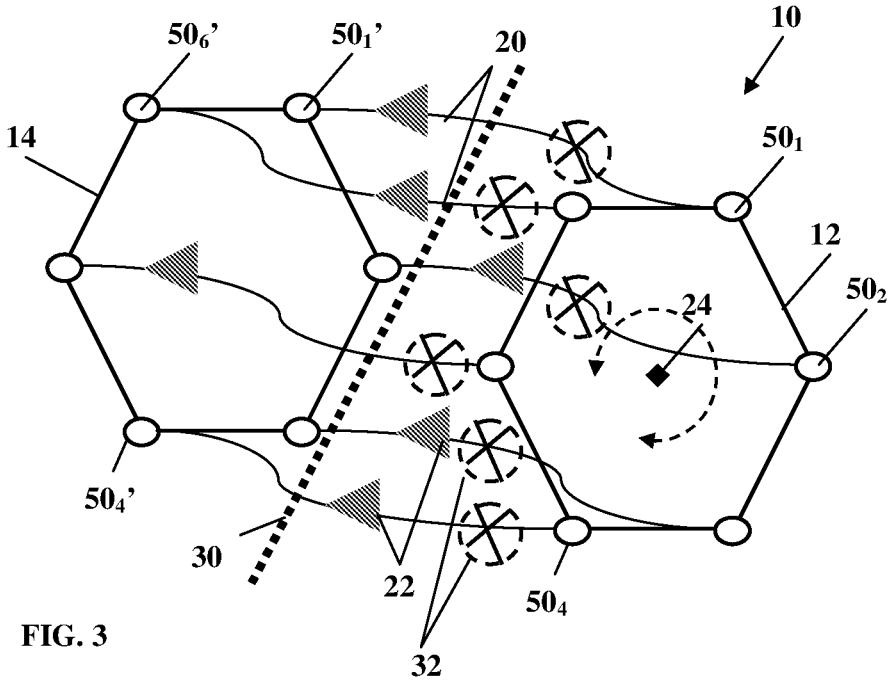
FIG. 3 exemplifies a configuration of a transponder according to some embodiments of the present invention.

Reference is now made to FIG. 3 illustrating an example of transponder 10 wherein the first 12 and second 14 antenna arrays have a closed loop geometry. As shown, each antenna array includes six antenna elements $\mathbf{50}_1$-$\mathbf{50}_6$ and $\mathbf{50}_1'$-$\mathbf{50}_6'$ arranged in a closed loop polygonal geometry. In this example, the first antenna array 12 is rotatable with respect to the second antenna array 14 about a predetermined axis 24. However, as indicated above, either one or both of the antenna arrays may be configured to be rotatable about one or more axes to thereby provide flexibility in determining a desired angular shift between collected and collectively transmitted signals.

The antenna elements are interconnected between them by connection lines 20 in a corresponding order such that neighboring antenna elements in one array are connected to neighboring antenna elements in the other array. As indicated above, the connection lines 20 may include signal amplifiers 22 located therealong and configured to amplify the electric signals passing between the antenna elements. The signal amplifiers 22 are typically configured to amplify radio-frequency (RF) signals, or electric signals at any other desired frequency, and provide a bidirectional or unidirectional signal transmission and amplifying. Similar to the connection lines 20, the plurality of signal amplifiers 22 are configured to provide substantially similar signal manipulation/amplification, and have a similar band-width and gain and/or other electric properties.

It should be noted that the transponder system 10 according to various embodiments and configurations, including but not limited to transponder systems utilizing closed-loop antenna arrays and linear arrays (e.g. one or two-dimensional configuration of the antenna arrays), may utilize signal amplifiers 22 along the connection lines 20. However, when such signal amplifiers are used, the transponder 10 may in some cases include an isolation system/module 30 configured to prevent cross-talk between the antenna elements of the transponder 10. The isolation system 30 may utilize an arrangement of parasitic antenna elements, isolation layer (e.g. conductive sheet) or any other type of radio frequency (RF) isolation system configured to prevent cross talk between antenna elements of the first and second antenna arrays. The isolation system 30 is typically used to reduce resonance feedback signals caused by cross-talk between antenna elements of a single receiving-transmitting pair. Such an isolation system 30 may be used in the transponder 10 regardless of the use of signal amplifiers along the connection lines, while in case the transponder does utilize signal amplifiers, the isolation system 30 is preferably used since the amplifiers may generate a positive feedback loop and increase cross-talk noise. Accordingly, the EM isolation system is typically configured to provide damping of the cross-talk signal at a level comparable or higher than the amplifiers' gain. In this connection it should be understood that in some embodiments sufficient isolation between the arrays may also be achieved by location of the arrays with sufficient distance from one another or at different height levels (e.g. arrays whose gain is high in the horizontal plane position at different heights with respect to this plane and/or with sufficient distance between them). This provides that cross-talk signals are sufficiently attenuated due to the distance by more than the amplification gain.

Alternatively or additionally, as was also noted above, sufficient isolation may be achieved by utilizing antenna arrays having different spacing between their antenna elements. In such cases, in order to maintain coherency of the transmitted signals, the signals to be transmitted are reconstructed with different frequencies than the received signals. It should be noted that employing different frequencies at the receiving and transmitting arrays allows the system to selectively amplify the transmitted signal. For example, the receiving frequency can be filtered out before amplifying the transmitted signal, by an appropriate filtering of the signal before the amplifier. To this end, the connection transducer, or its connection lines, may include one or more filters configured to filter out frequency components associated with the received signals while transferring frequency components associated with the transmitted signals. Filtering parameters may be determined in accordance with spacing between antenna elements of the first and second antenna arrays. Also, in certain cases, the antenna elements of the receiving and transmitting arrays may be characterized with different frequency responses. These techniques contribute to reduced cross-talk between the first and second antenna arrays and thus improve efficiency and signal-to-noise ratio.

To this end, optionally according to some embodiments of the present invention, the isolation system 30 includes frequency divider(s)/multiplier(s) 32 which may be for example associated with the connection lines 20 and which may be configured in accordance with spacings $d_r$ and $d_t$ of the antenna arrays (e.g. configured with multiplication/division ratios enabling to preserve the above mentioned relation $$f_t = \frac{d_r}{d_t} f_r$$

between the frequency $f_t$ of the transmitted signals and the frequency $f_r$ of the received signals).

The closed loop configuration of the first 12 and second 14 antenna arrays, as shown in FIG. 3, provides the transponder 10 of the present invention with an ability for omni-directional collection and transmission of electromagnetic signals, i.e. the transponder is capable of collecting electromagnetic signals (waveforms) arriving from substantially any direction and re-transmit corresponding signals with a desired angular shift relative to the collected signal. It should be noted that a planar closed-loop configuration of the array typically provides radiation collection from 360 degrees around the antenna array. This is while the exact configuration of the antenna elements (i.e. antenna elements type/polarization/orientation) may vary with the degree of radiation collection outside of a plane defined by the array. Specifically, the configuration/type of the antenna elements and the corresponding structure of their elemental beam actually define preferred directions for EM radiation collection transmission (e.g. shape, polarization and orientation of the reception/transmission beams).

Figure 4:
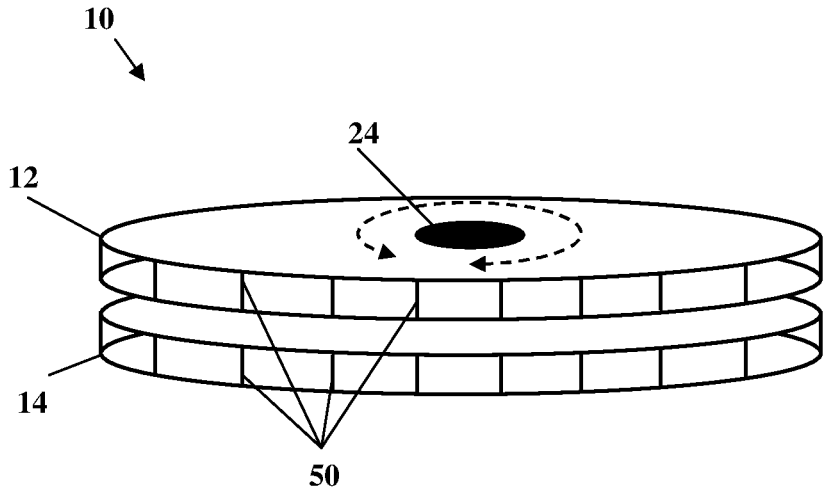
FIG. 4 exemplifies one other configuration of a transponder according to the present invention.

Another closed loop configuration of the transponder according to an embodiment of the present invention is exemplified in FIG. 4. Here the transponder 10 includes two circular antenna arrays 12 and 14 (i.e. polygonal arrays) arranged one on top of the other and independently rotatable with respect to one other about a common axis 24. Each of the first and second antenna arrays includes a plurality of antenna elements 50. The antenna elements of the different arrays are paired between them to form a plurality of receiving-transmitting pairs. Other possible elements of the transponder, such as wired connection lines, actuation module, control unit, signal amplifiers etc, may optionally be located near the rotation axis (e.g. within the circle created by the antenna arrays to reduce/prevent interference on the connection lines).

Although the antenna elements 50 are shown as having single orientation, it should be noted that the antenna elements of the transponder according to the present invention may be configured as electric monopole, electric dipole, magnetic dipole or any other type of antenna elements, and may be positioned with any orientation to collect or transmit EM radiation of any polarization. Antenna elements or each array may be arranged with the same or different orientation to interact with EM radiation of the same or different (e.g. orthogonal) polarization. Additionally, antenna elements of each pair may be of a similar orientation/polarization or of different orientation/polarization. Such polarization variation may cause the transponder to repeat/transpond collected signals with the desired angular shift and with an altered polarization.

Figure 5:
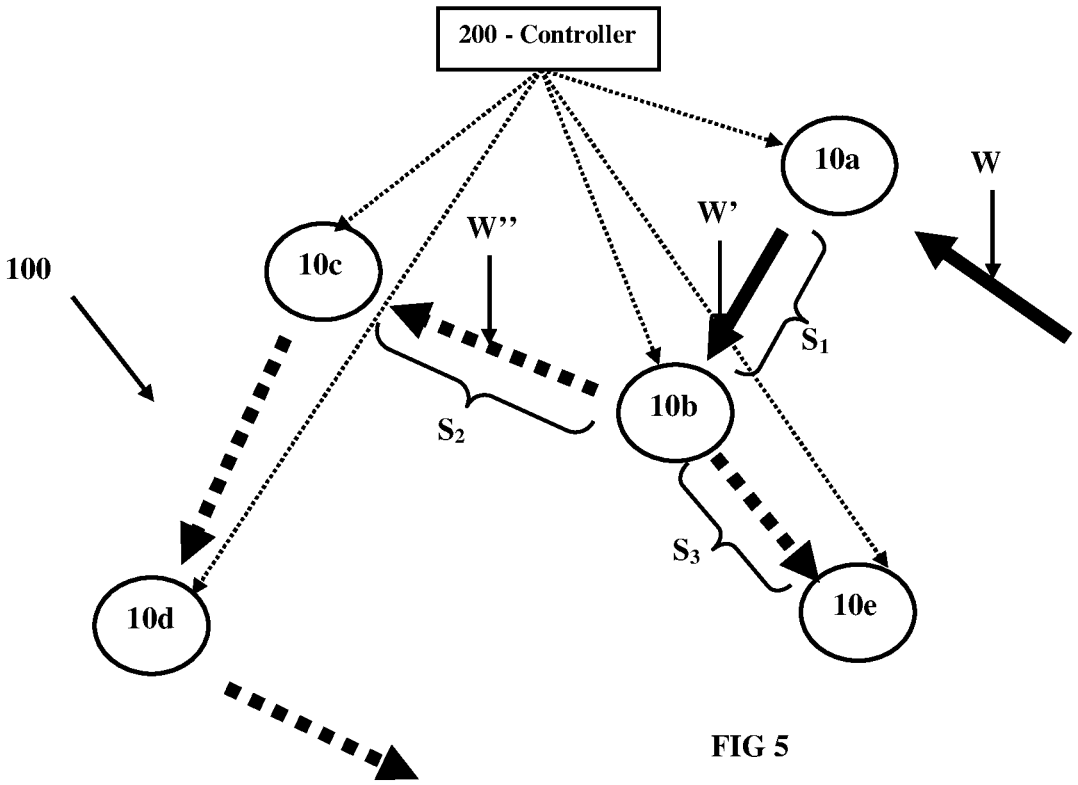
FIG. 5 illustrates a signal transmission network based on a plurality of transponder systems.

According to some embodiments of the present invention there is provided a signal transmission network comprising one or more transponder systems as described above. Reference is made to FIG. 5 illustrating a signal transmission network 100 utilizing a plurality (generally, at least two, five in this non-limiting example) of transponder systems 10*a*-10*e*, wherein at least one of them is configured according to the present invention. The transponder systems 10*a*-10*d* are positioned successively along a predetermined signal path/propagation trajectory and each of them is configured to receive an EM signal/waveform and transmit a corresponding EM signal/waveform with a desired/predetermined angular shift with respect to the received signal/waveform. Transponder system 10*e* is positioned to enable an alternative signal trajectory, enabled by varying the angular shift provided by transponder system 10*b*. To this end, each of the transponder systems 10*a*-10*e* is configured to repeat collected EM signals/waveforms with a selected angular shift in accordance with a desired signal path/trajectory, e.g. in accordance with cornering angles associated with the desired trajectory segment where the transponder systems are located. Thus, transponder system 10*a* receives input signal/waveform W, and redirects a corresponding output signal W' along a segment $S_1$ of the trajectory towards a selected destination where system 10*b* is located; system 10*b* generates a corresponding output signal W" to propagate along a selected successive trajectory segment (e.g. $S_2$ or $S_3$), such that the signal/waveform is redirected/propagated to the following transponder-system or receiver along the selected trajectory at which it can be received or further retransmitted. Each of the transponder systems 10*a*-10*e* of the signal transmission network 100 receives and transmits signals from a certain selected preceding transponder system (located upstream thereof with respect to the desired signal path/trajectory) to a selected successive transponder system (located downstream thereof along the selected path). The signal transmission network 100 may include, or be associated with, one or more signal sources (transmission utilities) which are capable of feeding the network 100 with signals/waveforms to be wirelessly transmitted therethrough along a selected trajectory. Additionally, the signal transmission network 100 may also include, or be associated with, one or more signal receivers (receiving utilities) which are capable of collecting signals/waveforms which are wirelessly propagated/transmitted along a selected trajectory in the network 100.

According to some embodiments, the signal transmission network 100 also includes a controller 200 connected to one or more of the transponder systems (by wired or wireless connection). The controller 200 may be configured to utilize data indicative of a desired trajectory(ies) for signal transmission through the signal transmission network 100 and is configured for generating operational data for operating the one or more transponder systems to adjust their angular shift for establishing the desired trajectory. In particular, the controller may communicate the operational data/instructions to the one or more transponder systems 10*a*-10*e* for rotating their rotatable antenna array(s) to vary the selected angular shift between collected and collectively transmitted EM signals/waveforms and thereby establish their trajectory.

In this regard, the controller 200 may be associated with a wired and/or wireless communication module (not specifically shown) capable of communicating operational instructions/data to the communication modules (i.e. 72 in FIG. 1 above) of the one or more transponder systems 10*a*-10*e*. In accordance with certain embodiments of the invention, the operational instructions may be communicated by utilizing the signal transmission network 100 itself. Specifically, in such embodiments the operational data/instructions for each of the transponder systems 10*a*-10*e* along the route may be encoded to signal/waveform which is to be transmitted through the selected route while each of the communication modules (i.e. 72) may be adapted for identifying these encoded instructions in the waveform and operate their respective transponder systems accordingly (e.g. operate their respective actuation module).

The signal trajectory/route provided by the transmission network 100 may be controllably adjusted by varying the angular shift provided by any one of the transponder systems 10*a*-10*e*. When a different route is desired, the rotatable antenna array of the transponder systems along the desired route may be rotated to provide suitable angular shifts of signal retransmission thereby to establish a transmission path along the desired route for directing signal transmission along the new route. It should be noted that each transponder system configured as described above provides a certain/selected angular shift between the collected and transmitted signals irrespective of the direction of the received signals. Thus, the direction of a signal transmitted by a certain transponder system relates to the direction from which the signal is received. Therefore, the angular shifts provided by any of the transponder systems 10*a*-10*e* of the signal transmission network 100 should be adjusted to comply with the selected trajectory (as may be operated by the controller 200).

As illustrated in FIG. 5, the respective locations of the transponder systems 10*a*-10*e* in the network 100 may be selected to provide more than one possible route. In this non-limiting example, transponder system 10*b* may be operated to provide a certain angular shift, directing signals propagating along segment $S_1$ towards segment $S_2$, or a certain different angular shift directing the signals arriving through segment $S_1$ to propagate along segment $S_3$. Additionally, locations of the transponder systems 10*a*-10*e* in the signal transmission network may be arranged to enable dynamic establishment of multiple concurrent signal transmission trajectories through the network (e.g. the different trajectories may be between pluralities of transmitters to a plurality of receivers). For example, the transponder systems may be located in a lattice formation and/or the location of one or more of the transponder systems may be configured to enable concurrent signal repetition/replication between two pairs of signal sources and destinations (e.g. other transponders and/or receivers and transmitters).

Thus, the present invention provides a simple configuration of a reliable and efficient transponder system enabling controllable adjustment of the angular shift between the received and repeated signals/waveforms and thus being capable of desirably varying its repeating pattern. Also, the invention provides a signal transmission network comprising a plurality of transponder systems and capable of exploiting the adjustability of the angular shift of the transponder systems to enable establishment of selected transmission paths. Those skilled in the art will readily appreciate that various modifications and changes can be applied to the embodiments of the invention as hereinbefore described without departing from its scope defined in and by the appended claims.

The invention claimed is:

1. A transponder system, comprising:

a first antenna array and a second antenna array each including a plurality of antenna elements arranged in a predetermined geometry of said plurality of antenna elements, the plurality of antenna elements of the first antenna array being respectively interconnected with corresponding antenna elements of the plurality of antenna elements of the second antenna array by respective connection lines to form a plurality of receiving-transmitting pairs of antenna elements, each of said receiving-transmitting pairs being configured to receive an input electromagnetic signal by one antenna element thereof and transmit a corresponding output electromagnetic signal by a corresponding antenna element thereof, thereby enabling collective collection of an input electromagnetic waveform, by one of said first and second antenna arrays and collective transmission of a corresponding output electromagnetic waveform by another one of said first and second antenna arrays;

whereby the respective connection lines have substantially similar length and electrical properties thereby providing that a direction of propagation of the corresponding output signal waveform is relative to direction of propagation of the collected signal waveform;

at least one of said first and second antenna arrays being selectively and changeably rotatable with respect to the other about at least one predetermined rotation axis to thereby enable selected angular shift in direction of propagation of the output signal waveform with respect to direction of propagation of the collected signal waveform;

wherein said transponder system is formed by analog circuitry comprising said connection lines of the substantially similar length and electrical properties, thereby obviating a need for processing the received input electromagnetic signals associated with said collective receipt of the input signal waveform for forming the transmitted output electromagnetic signals associated with the collective transmission of the corresponding output signal waveform with said angular shift with respect to direction of propagation of the collected signal waveform.

2. The transponder of claim 1, wherein each antenna element of the first antenna array is connected to a corresponding antenna element of the second array in accordance with sequential location of the antenna elements within the first and second arrays to form said receiving-transmitting pairs.

3. The transponder of claim 1, wherein said first and second antenna arrays are configured with substantially similar geometries.

4. The transponder of claim 1, wherein said first and second antenna arrays have linear geometries.

5. The transponder of claim 1, wherein said first and second antenna arrays have two-dimensional geometries.

6. The transponder of claim 1, further comprising an actuation module connected to said at least one rotatable antenna array and configured to enable controllable rotation of said rotatable antenna array about said at least one predetermined rotation axis.

7. The transponder of claim 6, further comprising a control unit connected to said actuation module and configured for receiving data indicative of a desired angular shift between direction of propagation of the output signal wavefront with respect to direction of propagation of the collected signal waveform, and for operating said actuation module to vary a relative angle between said first and second antenna arrays for providing said angular shift.

8. The transponder of claim 7, wherein said control unit comprises a wireless communication module configured to receive appropriate control signals indicative of said angular shift, said control unit being responsive to said appropriate control signals to operate said actuation module accordingly to thereby enable remote variation of said relative angle between said first and second antenna arrays.

9. The transponder of claim 1, further comprising a plurality of signal amplifiers respectively associated with said connection lines and configured to amplify signals passing between the associated antenna elements of the corresponding receiving-transmitting pair.

10. The transponder of claim 9, wherein said plurality of signal amplifiers are configured to provide substantially similar signal amplification.

11. The transponder of claim 1, wherein said plurality of antenna elements comprises antenna elements configured to receive and transmit electromagnetic radiation with two or more different polarization orientations.

12. The transponder of claim 1, further comprising an isolation system configured to reduce cross talk between antenna elements of said first and second antenna arrays.

13. The transponder of claim 12, further comprising a plurality of signal amplifiers respectively associated with said connection lines and wherein said isolation system is configured to suppress said cross talk by a factor greater than signal amplification provided by said signal amplifiers.

14. The transponder of claim 12, wherein said isolation system comprises at least one of the following: (a) one or more parasitic antennas; (b) an electromagnetic isolation layer; (c) one or more frequency dividers/multipliers configured to change the frequency of the transmitted signals relative to the frequency of the received signals in accordance with the antenna elements' spacings of said first and second antenna arrays; or (d) one or more filters configured to filter out frequency components associated with the received signals while transfer frequency components are associated with the transmitted signals in accordance with antenna elements' spacing of said first and second antenna arrays.

15. The transponder of claim 1, wherein said first and second antenna arrays have substantially similar spacing between their antenna elements.

16. The transponder of claim 1, wherein said first and second antenna arrays are located on a substantially parallel plane intersecting with an axis of rotation of said at least one rotatable antenna array.

17. The transponder of claim 1, wherein said first and second wherein said first and second antenna arrays have closed loop geometry within a plane perpendicular to said at least one predetermined rotation axis.

18. The transponder of claim 17, wherein said first and second antenna arrays are circular or polygonal arrays of said plurality of antenna elements.

19. The transponder of claim 17, wherein said first and second antenna arrays are concentric with respect to one another, said at least one rotation axis includes an axis intersecting with a plane defined by at least one of the first or second antenna arrays at a center of the closed loop.

20. The transponder of claim 17, wherein said first and second antenna arrays are located in substantially parallel planes.

21. A signal transmission network, comprising:

two or more transponder systems, at least one transponder system of the two or more transponder systems comprises:

a first antenna array and a second antenna array each including a plurality of antenna elements arranged in a predetermined geometry of said plurality of antenna elements, the plurality of antenna elements of the first antenna array being respectively interconnected with corresponding antenna elements of the plurality of antenna elements of the second antenna array by respective connection lines to form a plurality of receiving-transmitting pairs of antenna elements, each of said receiving-transmitting pairs being configured to receive an input electromagnetic signal by one antenna element thereof and transmit a corresponding output electromagnetic signal by a corresponding antenna element thereof, thereby enabling collective collection of an input signal waveform by one of said first and second antenna array and transmission of a corresponding output signal waveform by another one of said first and second antenna arrays;

wherein the respective connection lines having substantially similar length and electrical properties thereby providing that a direction of propagation of the corresponding output signal waveform is relative to direction of propagation of the collected signal waveform;

at least one of said first and second antenna arrays being selectively and changeably rotatable with respect to the other about at least one predetermined rotation axis to thereby enable selected angular shift in direction of propagation of the output signal waveform with respect to direction of propagation of the collected signal waveform; and wherein said transponder system is formed by analog circuitry comprising connection lines of substantially similar length and electrical properties between the receiving-transmitting pairs of antenna elements of the first and second arrays, thereby obviating a need for processing the received input electromagnetic signals associated with said collective receipt of the input signal waveform for forming the transmitted output electromagnetic signals associated with the collective transmission of the corresponding output signal waveform;

said two or more transponders being arranged at certain locations to enable establishment of a signal propagation trajectory along the signal transmission network, such a segment of said signal propagation trajectory being defined between two adjacent transponder systems;

wherein control over the angular shift provided by said at least one transponder system enabling establishment of a desired signal propagation trajectory along the network.

22. The signal transmission network of claim 21, further comprising a controller connectable to said at least one transponder system and configured and operable to utilize data indicative of a desired trajectory for signal transmission along said signal transmission network, determine at least one corresponding angular shift for said at least one transponder system, and communicate operational instructions indicative of said at least one corresponding angular shift to said at least one transponder system respectively to thereby establish said desired trajectory through the signal transmission network.

23. A transponder, comprising:

a plurality of antenna elements associated with first and second antenna arrays having predetermined closed-loop geometry and spacing of said plurality of antenna elements, said closed loop geometry defining respective parallel planes of the first and second antenna arrays;

wherein each antenna element of the first antenna array is connected to a corresponding antenna element of the second antenna array via a connection line to thereby form a plurality of receiving-transmitting pairs of antenna elements, such that the plurality of receiving-transmitting pairs of antenna elements are associated with a respective plurality of connection lines being of substantially similar lengths and electrical properties;

wherein at least one of said first and second antenna arrays is selectively and changeably rotatable with respect to the other about at least one axis perpendicular to said planes, to thereby enable selected angular shift in a relative angle between said first and second antenna arrays; and wherein said transponder is formed by analog circuitry comprising said connection lines of the substantially similar length and electrical properties between the receiving-transmitting pairs of antenna elements of the first and second arrays, thereby obviating a need for processing the input electromagnetic signals received by antenna elements of one of said first and second antenna arrays for forming output electromagnetic signals transmitted by antenna elements of another one of said first and second antenna arrays with said selected angular shift in a relative angle between said first and second antenna arrays.

* * * * *